US007665391B2

(12) United States Patent
Beauchamp

(10) Patent No.: US 7,665,391 B2
(45) Date of Patent: Feb. 23, 2010

(54) MULTI-BIT SCREWDRIVER

(75) Inventor: Fern Beauchamp, St. Catharines (CA)

(73) Assignee: Dragonfire Group Holdings Limited Company, Hong Kong (HK)

( * ) Notice: Subject to any disclaimer, the term of this patent is extended or adjusted under 35 U.S.C. 154(b) by 0 days.

(21) Appl. No.: 11/421,063

(22) Filed: May 30, 2006

(65) Prior Publication Data

US 2007/0277654 A1 Dec. 6, 2007

(51) Int. Cl.
*B25G 1/08* (2006.01)

(52) U.S. Cl. ..... 81/177.4; 81/177.1; 81/177.6; 81/439; 81/480

(58) Field of Classification Search ..... 81/177.1, 81/177.4, 177.6, 439, 490, 480
See application file for complete search history.

(56) References Cited

U.S. PATENT DOCUMENTS 5,325,745 A * 7/1994 Koehler ..... 81/439
6,205,893 B1 * 3/2001 Sato ..... 81/439
6,332,384 B1 * 12/2001 Cluthe ..... 81/490
2007/0251358 A1 * 11/2007 Grand et al. ..... 81/439

* cited by examiner

*Primary Examiner*—Joseph J Hail, III
*Assistant Examiner*—Shantese McDonald

(57) ABSTRACT

A multi-bit screwdriver comprises a housing with a bit chuck at the front end and bit assemblies retained within the housing. Each bit assembly has a tool bit at a front end and a contact surface at a back end. An actuator extends from each bit assembly for operative engagement by a user, for movement of the actuator and bit assembly between a forwardly extended in-use configuration whereat the bit assembly is positioned such that the tool bit extends outwardly from the housing, and the contact surface of the bit assembly is disposed in longitudinal force transmitting engagement against a forward facing abutment surface to preclude rearward movement of the bit assembly due to substantially longitudinally directed forces transmitted from the tool bit, and a retracted configuration whereat the contact surface of the bit assembly is removed in a lateral direction from the longitudinal force transmitting engagement with the forward facing abutment surface.

5 Claims, 12 Drawing Sheets

62
60

62
60

60
62

50

50

50

34
35
32
34
34
40

40

40
34
34
32
34

20
62
72
60
76
30
29
80
50
72
70
110
130
92
102
124
82
86
100
36
120
80
36
40
130
32
102
33
124
82
86
100
120
34
34
28
31

72
"T"
62
20
90
90
60
76
70
"L"
30
80
29
50
72
110
92
130
82
102
124
76
100
116
120
123
80
36
32
40
36
130
102
33
124
82
100
120
34
34
123
31

70
72
76
80
81
82
84
86
100
102
110
120
122
123
124
130
"P"
"T"

100
102
110
120
123
124
130
72
76
80
82
86

MULTI-BIT SCREWDRIVER

FIELD OF THE INVENTION

The present invention relates to multi-bit screwdrivers and more particularly relates to multi-bit screwdrivers, wherein the bits are slidably retained within the main housing, are selected for use using a single forward action, and are retracted by a single rearward action.

BACKGROUND OF THE INVENTION

Many different types of multi-bit screwdrivers are now available on the market. Early models of such multi-bit screwdrivers have a plurality of loose bits retained within a housing. A selected bit removed from the housing and placed into a bit chuck. Subsequently, the bit is removed from the bit chuck and replaced in the housing.

More recent types of multi-bit screwdrivers have bit assemblies that are mounted in sliding relation in a housing such that an external button is slid forwardly along the slot to present a single bit for use, extending outwardly from a bit chuck.

U.S. Pat. No. 6,332,384 issued Dec. 25, 2001, to Cluthe, discloses a multi-bit screwdriver wherein a plurality of bit assemblies are slidably mounted within the housing of a screwdriver. Each bit assembly has a tool bit and a bit extension pivotally connected at a front end to the back end of the tool bit. A disc shaped manipulation means (actuator button) disposed at the back end of the bit extension is disposed exteriorly to the housing for selective manual manipulation of the bit assembly. When a bit assembly is slid into a forwardly extended in-use position, a locking element engages a groove in the tool bit to lock it in place. As the bit assembly reaches the forwardly extended in-use position, its forward motion is inhibited by the locking element, necessitating the sleeve to be pulled back to its rearward position to release the locking elements so that the bit can pass fully out into the central through hole. The sleeve must then be released in order to return to its forward biased position and lock the bit in place. Accordingly, this is a multiple-step process, which is inconvenient. The Cluthe multi-bit screwdriver as described above is marketed under the name RETRACT-A-BIT™.

In order to retract the extended tool bit, a sleeve disposed at the front end of the housing must be slid rearwardly towards the housing to permit the locking element to be disengaged as the extended bit assembly is slid back into its retracted position and once the extended bit assembly is retracted, the sleeve is released and returned to its forward biased position.

A very similar but slightly more advanced version multi-bit screwdriver is marketed under the name RETRACT-A-BIT™ PRO. In this multi-bit screwdriver, when a bit assembly is slid into a forwardly extended in-use position, the locking element is retracted by the forward motion of the bit assembly. The sleeve must still be pulled back to its rearward position to release the locking elements to move the bit assembly to its retracted position, and must still be released and returned to its forward biased position.

While this arrangement works reasonably well, it is necessary to use two hands to retract an extended tool bit. This is highly undesirable since there are many instances where a person is holding an object in one hand and holding the screwdriver in the other hand to turn a threaded fastener into or out of the object. With the Cluthe multi-bit screwdriver, if another tool bit was required, it would be necessary to put the object down in order to retract the extended tool bit, since the Cluthe design does not permit single action retraction of an extended bit assembly. The sleeve must first be manually retracted to a rearward position thus freeing the locking element to move to its unlocking position, which takes two hands. A user may then slide the actuator button rearwardly to move the tool bit to its retraced position.

U.S. Pat. No. 5,325,745 to Koehler, discloses a screwdriver having a plurality of bit assemblies, with each bit assembly having a tool bit and rearwardly disposed hexagonal end. A leaf spring is attached to the central portion of the tool bit and terminates in a thumb piece disposed externally to the housing. In use, the thumb piece is slid forwardly and pushed inwardly to move the hexagonal end of the bit immediately in front of a cooperating hexagonal recess. This manipulation is quite difficult as there is no strict means for guiding the hexagonal end of the bit to a proper location in front of the hexagonal recess. Then, the thumb piece must be moved rearwardly to cause the hexagonal end to seat in the hexagonal recess, to thus realize the extended in-use position of the bit. This manipulation is also quite difficult, as the hexagonal end of the tool bit must be carefully guided into place with no room for error. This multiple bit screwdriver therefore requires multiple actions to extend the bit and lock it in its extended in-use position.

To move the bit from its extended in-use position to its retracted position, the thumb piece is slid forwardly, and pressure is released on the thumb piece to permit the hexagonal end of the tool bit to move laterally away from the hexagonal recess. The thumb piece is then slid rearwardly to move the attached tool bit to its retracted position. This multiple bit screwdriver therefore requires multiple actions to retract the bit and lock it in its retracted in-use position.

It is an object of the present invention to provide a multi-bit screwdriver wherein each bit assembly can be moved from a retracted position to an extended in-use configuration through one single forward sliding motion, and by this action be locked in its extended in-use configuration for use as a screwdriver and subsequently can be moved to its retracted configuration through one single rearward sliding motion. Each of these movements can be achieved by user using only one hand.

It is another object of the present invention to provide a multi-bit screwdriver wherein the tool bits can be moved to their extended in-use configuration and then back to their retracted configuration using one hand only, and which is a one step process.

SUMMARY OF THE INVENTION

In accordance with one aspect of the present invention there is disclosed a novel multi-bit screwdriver comprising a housing defining a longitudinal axis and a handle portion. A plurality of bit assemblies are operatively retained within the housing, each bit assembly having a tool bit at a front end and a contact surface at a back end. A bit chuck is disposed at one end of the housing for receiving the tool bits singularly in torque transmitting relation, and includes a bit-receiving opening for permitting the tool bits singularly to extend therethrough. A forward facing abutment surface is disposed within the housing. An actuator means extends from each bit assembly exteriorly to the housing for operative engagement by a user, for co-operative movement of the actuator means and the bit assembly between a retracted configuration, a forwardly extended in-use configuration whereat the bit assembly is positioned such that the tool bit extends outwardly from the housing through the opening of the bit chuck, and the contact surface of the bit assembly is disposed in longitudinal force transmitting engagement against the abutment surface to preclude rearward movement of the bit assembly due to substantially longitudinally directed forces transmitted from the tool bit, and back to said retracted configuration whereat the contact surface of the bit assembly is removed in a lateral direction from the longitudinal force transmitting engagement with the abutment surface.

In accordance with another aspect of the present invention there is disclosed a novel multi-bit screwdriver comprising a housing defining a longitudinal axis and a handle portion. A plurality of bit assemblies are operatively retained within the housing. There is means on the housing for receiving the tool bits singularly in torque transmitting relation. A rearward facing abutment surface is disposed within the housing. A forward facing abutment surface is disposed within the housing. An actuator means extends from each bit assembly exteriorly to the housing for operative engagement by a user, for co-operative movement of the actuator means and the bit assembly between a retracted configuration, a forwardly extended intermediate configuration whereat the tool bit extends outwardly from the housing and the bit assembly contacts the rearward facing abutment surface, and a forwardly extended in-use configuration whereat the contact surface of the bit assembly is disposed in longitudinal force transmitting engagement against the forward facing abutment surface to preclude rearward movement of the bit assembly due to substantially longitudinally directed forces transmitted from the tool bit, and back to said retracted configuration whereat the contact surface of the bit assembly is removed in a lateral direction from the longitudinal force transmitting engagement with the abutment surface.

In accordance with yet another aspect of the present invention there is disclosed a novel multi-bit screwdriver comprising a housing defining a longitudinal axis and a handle portion. A plurality of bit assemblies are operatively retained within the housing. A rearward facing abutment surface disposed within the housing. A flexible actuator member extends from each bit assembly exteriorly to the housing for operative engagement by a user, and mounted in sliding relation within a slot in the housing for co-operative movement of the actuator means and the bit assembly between a retracted configuration, a forwardly extended intermediate configuration whereat the tool bit extends outwardly from the housing and the bit assembly contacts the rearward facing abutment surface, a forwardly extended in-use configuration, and back to said retracted configuration. There is means for receiving the tool bits singularly in torque transmitting relation when the bit assembly is in the forwardly extended in-use configuration. There is also means for receiving each bit assembly in longitudinal force transmitting engagement thereagainst, to preclude rearward movement of the bit assembly due to substantially longitudinally directed forces transmitted from the tool bit.

In accordance with yet another aspect of the present invention, in a multi-bit screwdriver having a plurality of bit assemblies operatively retained within a housing, the bit assemblies being selectively movable between a forwardly extended in-use configuration and a retracted configuration, there is a novel improvement. Each bit assembly has a tool bit at a front end and a contact surface at a back end. There is a longitudinal channel for each bit assembly, having a front end and a back end. Each bit assembly slides along its longitudinal channel between the retracted configuration and the forwardly extended in-use configuration. An abutment surface is disposed at the front end of each longitudinal channel and is oriented substantially transversely to each longitudinal channel, for receiving the contact surface of the bit assembly longitudinal force transmitting engagement when the bit assembly is in the forwardly extended in-use configuration.

In accordance with yet another aspect of the present invention, in a multi-bit screwdriver having a plurality of bit assemblies operatively retained within a housing, the bit assemblies being selectively movable between a forwardly extended in-use configuration and a retracted configuration, there is a novel improvement. Each bit assembly has a tool bit at a front end and a contact surface at a back end. There is a longitudinal guide surface for each bit assembly, having a front end and a back end. Each bit assembly slides along its longitudinal guide surface between the retracted configuration and the forwardly extended in-use configuration. An abutment surface is disposed at the front end of each longitudinal guide surface and oriented substantially transversely to each the longitudinal guide surface, for receiving the contact surface of the bit assembly longitudinal force transmitting engagement when the bit assembly is in the forwardly extended in-use configuration.

In accordance with still another aspect of the present invention, in a multi-bit screwdriver having a plurality of bit assemblies operatively retained within a housing, the bit assemblies being selectively movable between a forwardly extended in-use configuration and a retracted configuration, there is a novel improvement. Each bit assembly has a tool bit with a first stop surface and a bit extension with a second stop surface and defining a longitudinal axis. The tool bit is pivotally attached to the bit extension for pivotal movement about a pivot axis oriented substantially transversely to the longitudinal axis between an oblique angular position and a forward-oriented angular position whereat the first and second stop surfaces abut against each other.

In accordance with still another aspect of the present invention, there is disclosed a novel bit assembly for use in multi-bit driver. The bit assembly comprises a tool bit having a first stop surface, and a bit extension having a second stop surface and defining a longitudinal tool bit axis. The tool bit is pivotally attached to the bit extension for pivotal movement about a pivot axis oriented substantially transversely to the longitudinal tool bit axis between an oblique angular position, and a forward-oriented angular position whereat the first and second stop surfaces abut against each other in force transmitting relation.

In accordance with still another aspect of the present invention, there is disclosed a novel bit extension for use in a bit assembly of a multi-bit driver. The bit extension comprises a main body having a front end and a back end, and a stop surface at the front end.

In accordance with still another aspect of the present invention, there is disclosed a novel multi-bit driver comprising a housing defining a longitudinal axis, and a forward facing abutment surface disposed within the housing. A plurality of bit assemblies are operatively retained within the housing, each bit assembly having a tool bit and a bit extension operatively attached to the tool bit. A bit chuck is disposed at one end of the housing for receiving the tool bits singularly in torque transmitting relation, and includes a bit-receiving opening for permitting the tool bits singularly to extend therethrough. An actuator means is for moving the bit assembly between a retracted configuration, a forwardly extended in-use configuration whereat the bit extension is interposed between the tool bit and the forward facing abutment surface, and back to the retracted configuration.

In accordance with still another aspect of the present invention, there is disclosed a novel bit assembly for use in a multi-bit driver. The bit assembly comprises a tool bit, a bit extension operatively attached to the tool bit, and an actuator means operatively attached to the bit extension, for moving the bit assembly between a retracted configuration, a forwardly extended in-use configuration, and back to the retracted configuration.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the multi-bit screwdriver according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. The invention will now be described by way of example with reference to the following drawings in which.

DETAILED DESCRIPTION OF A PREFERRED EMBODIMENT

Figure 2:
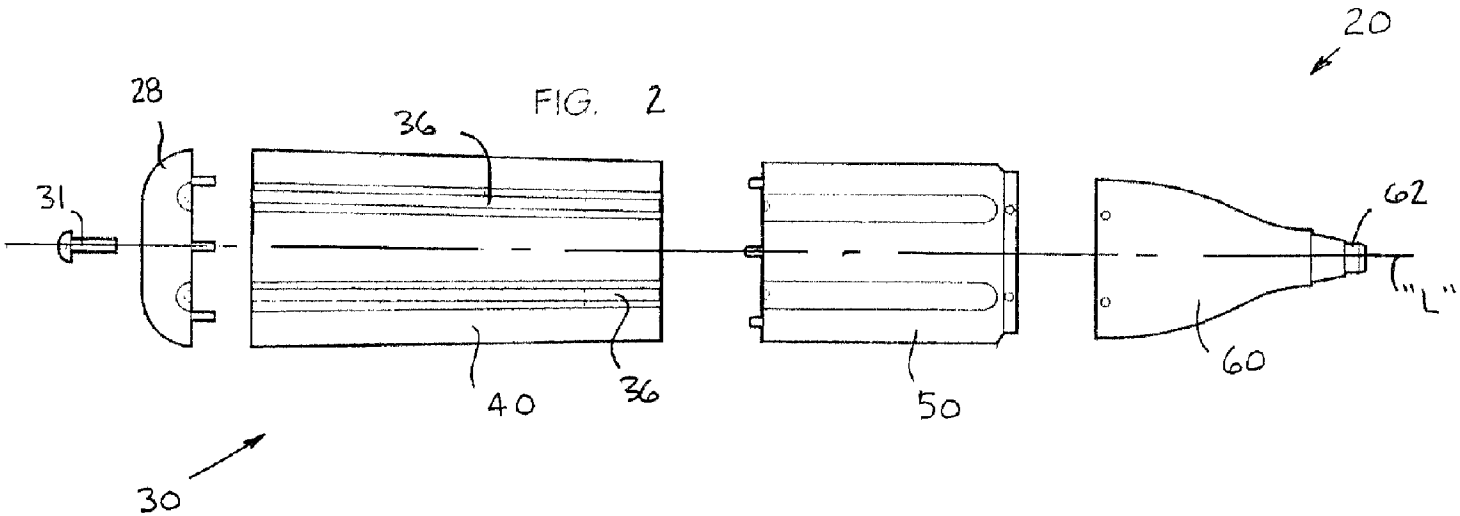
FIG. 2 is an exploded side elevational view of the multi-bit screwdriver of FIG. 1.
Figure 1:
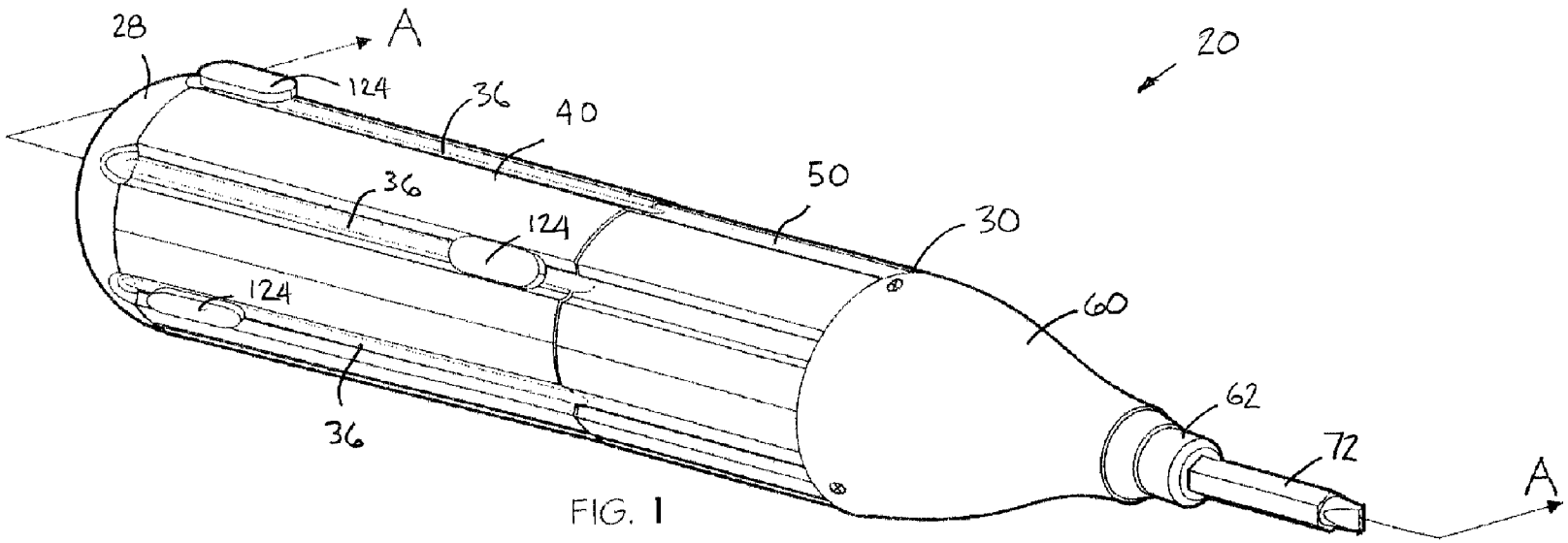
FIG. 1 is a perspective view from the front of the preferred embodiment multi-bit screwdriver according to the present invention.
Figures 3, 4, 5, 6, 7, 8, 9, 10, 11:
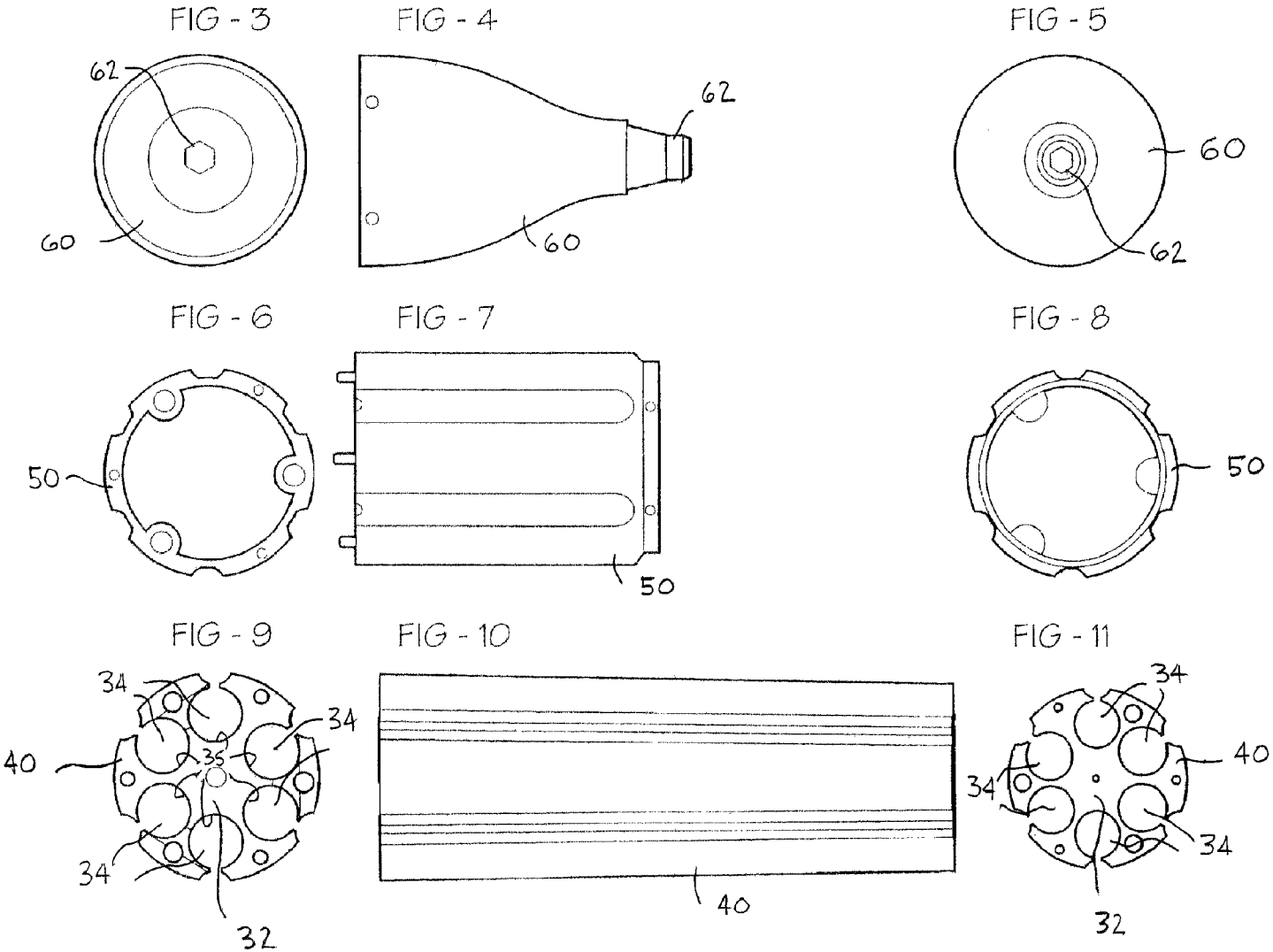
FIG. 3 is a back end elevational view of the cone portion of the multi-bit screwdriver of FIG. 1.
FIG. 4 is a side elevational view of the cone portion shown in FIG. 3.
FIG. 5 is a front end elevational view of the cone portion shown in FIG. 4.
FIG. 6 is a back end elevational view of the central transition portion of the multi-bit screwdriver of FIG. 1.
FIG. 7 is a side elevational view of the central transition portion shown in FIG. 6.
FIG. 8 is a front end elevational view of the central transition portion shown in FIG. 6.
FIG. 9 is a back end elevational view of the handle portion of the multi-bit screwdriver of FIG. 1.
FIG. 10 is a side elevational view of the handle portion shown in FIG. 9.
FIG. 11 is a front end elevational view of the handle portion shown in FIG. 9.
Figure 52:
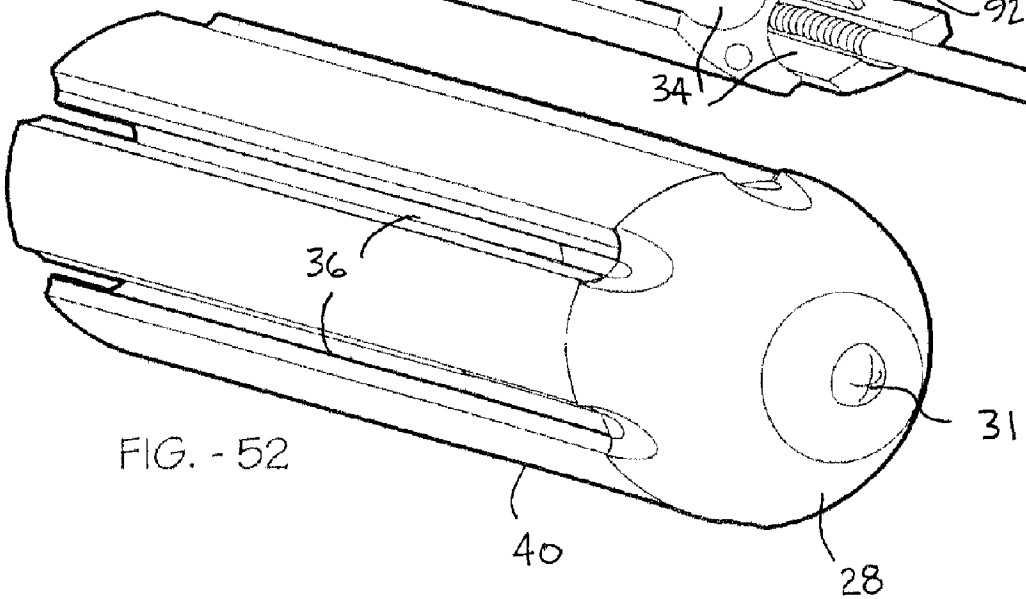

Reference will now be made to FIGS. 1 through 52, which show a preferred embodiment of the multi-bit screwdriver of the present invention, as indicated by general reference numeral 20. The multi-bit screwdriver 20 comprises a housing 30 defining a longitudinal axis "L", and a handle portion 40, a central transition portion 50, a cone portion 60. The housing 30 tapers at a cone portion 60 from the central transition portion 50 to a bit chuck 62 that will be described in greater detail subsequently. Alternatively, the central transition portion 50 and the cone portion 60 could be one integral piece. The housing 30 also comprises a longitudinally directed central column 32 disposed within the housing 30. A plurality of channels 34, specifically six in the preferred embodiment, surround and define the central column 32.

An end cap 28 is secured onto the back end of the housing 30 by means of a threaded fastener 31 that engages a co-operating bore hole 33 in the central column 32.

A plurality of bit assemblies, as indicated by the general reference numeral 70, specifically six bit assemblies 70 in the preferred embodiment, are operatively retained within the housing 30. The bit assemblies 70 each having an actuator attached thereto are shown separately in FIGS. 15 through 23. Each bit assembly 70 has a tool bit 72 at a front end and a bit extension 80 that is operatively attached in hinged relation, and preferably pivotally attached to the tool bit 72. Alternatively, a living hinge arrangement could be used to operatively attach in hinged relation the bit extension 70 to the tool bit 72. Alternatively, the tool bit 72 and the bit extension 80 could be joined to form a single unit alternative embodiment bit assembly, such that the bit extension portion of the bit assembly or the joint or both is sufficiently flexible in the radial direction and rigid enough to reduce its degree of freedom.

The bit extension 80 comprises a main body 80*a* having a front end 80*f* and a back end 80*b*, and includes a pin receiving aperture 83 therein at the pivot axis "P". The tool bit 72 has a rear arm portion 73 that extends rearwardly past the first stop surface 74, and a pivot pin 75 that projects a transversely from the rear arm portion 73 so as to be disposed immediately rearwardly of the first stop surface 74. The rear arm portion 73 and the pivot pin 75 are a part of the overmolded plastic back end portion 76. The pivot pin 75 is disposed in pivotal relation within the pin receiving aperture 83 in the bit extension 80, to thereby pivotally attach the tool bit 72 to the bit extension 80. Each bit extension 80 has a contact surface 82 at a back end 86, as will be discussed in greater detail subsequently, and is made from a suitable rigid material such as aluminum, cold rolled steel, plastic, and so on.

Each tool bit 72 has a first stop surface 74 and each bit extension 80 has a second stop surface 82 at the front end 80*f*, and defines a longitudinal tool bit axis "T". Further, each tool bit 72 comprises an overmolded plastic back end portion 76. The tool bit 72 is pivotally attached at its overmolded plastic back end portion 76 to the bit extension 80 for pivotal movement about a pivot axis "P" oriented substantially transversely to the longitudinal tool bit axis "T" between a oblique angular positions, as is shown in dashed lining in FIG. 23, and a forward-oriented angular position, as is shown in solid lining in FIG. 23. In the forward-oriented angular position, the first and second stop surfaces 74, 82 abut against each other in force transmitting relation, as will be discussed in greater detail subsequently.

There is means on the housing 30 for receiving the tool bits 72 singularly, or in other words one at a time, in torque transmitting relation. In the preferred embodiment, as illustrated, the means for receiving the tool bits 72 comprises a bit chuck 62 disposed at one end of the housing 30 and integrally formed within the housing 30 specifically with the cone portion 60, so as to be substantially solid. The bit chuck 62 includes a bit-receiving opening 64 for permitting the tool bits 72 singularly to extend therethrough. The bit-receiving opening 64 is lengthy enough along the longitudinal axis "L" and is of suitable dimension to retain a tool bit received therein substantially aligned with the longitudinal axis "L". In the above described manner, when the handle portion 40 of the housing 30 is turned by a user, torque is transmitted from the housing 30 to the tool bits 72, thus causing the tool bits 72 to turn with the housing 30.

The housing 30 also comprises a rearward facing abutment surface 90 disposed within said housing 30, preferably on the cone portion 60 adjacent the bit chuck 62. The rearward facing abutment surface 90 receives a portion of the overmolded plastic back end portion 76 thereagainst, as will be discussed in greater detail subsequently.

A forward facing abutment surface 92 is disposed within the housing 30, preferably on the central column 32. The forward facing abutment surface 92 receives the contact surface 82 of the bit extension 80 thereagainst, as will be discussed in greater detail subsequently.

Figures 24, 25, 26, 27, 28, 29, 30, 31, 32, 33, 34, 35, 36, 37, 38, 39, 40, 41, 42, 43:
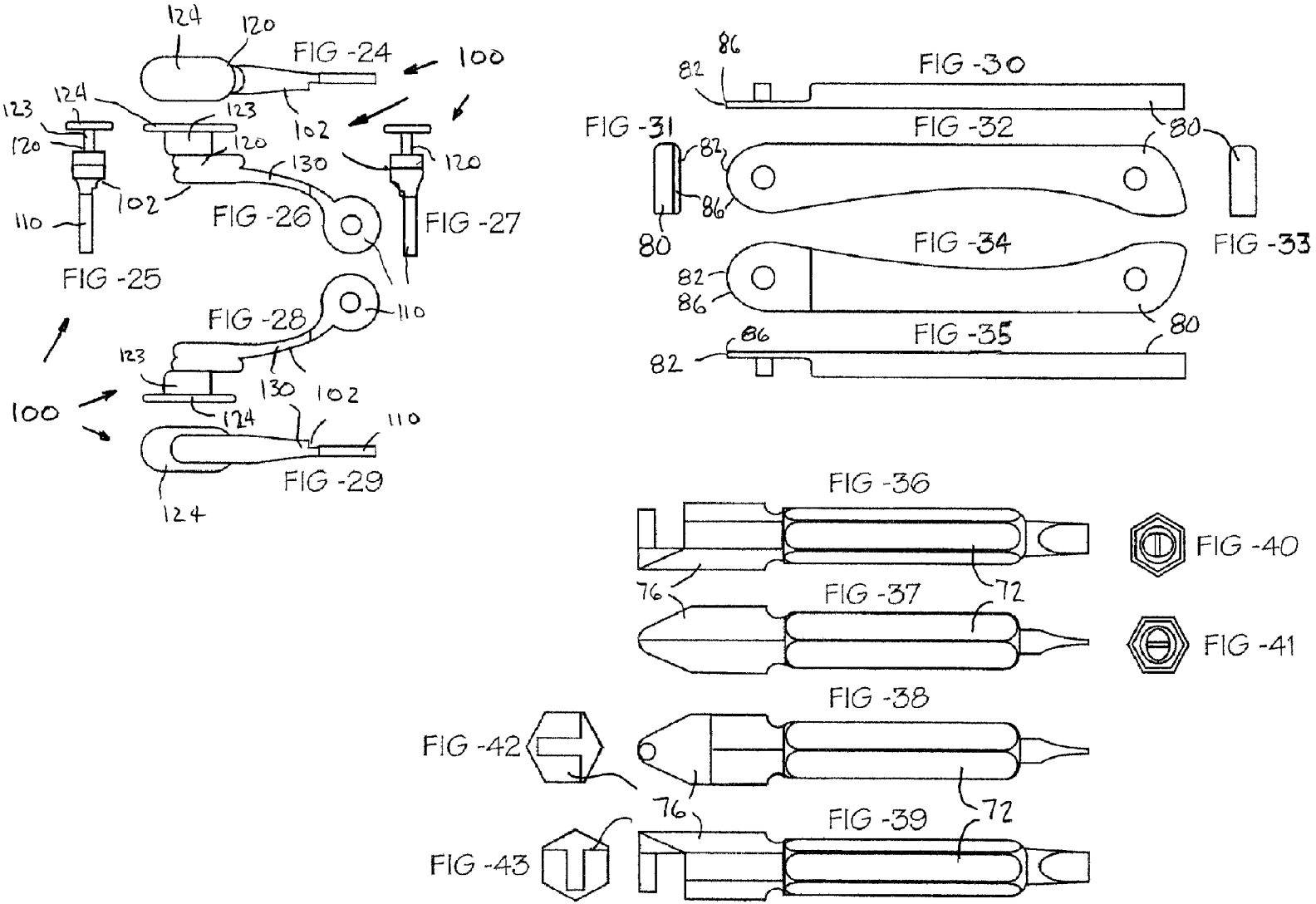
FIG. 24 is a top plan view of the actuator member of the bit assembly.
FIG. 25 is a back end view of the actuator member of FIG. 24.
FIG. 26 is a right side elevational view of the actuator member of FIG. 24.
FIG. 27 is a front end view of the actuator member of FIG. 24.
FIG. 28 is an inverted left side elevational view of the actuator member of FIG. 24.
FIG. 29 is a bottom plan view of the actuator member of FIG. 24.
FIG. 30 is a top plan view of the bit extension of the bit assembly.
FIG. 31 is a back end view of the bit extension of FIG. 30.
FIG. 32 is a right side elevational view of the bit extension of FIG. 30.
FIG. 33 is a front end view of the bit extension of FIG. 30.
FIG. 34 is an inverted left side elevational view of the bit extension of FIG. 30.
FIG. 35 is a bottom plan view of the bit extension of FIG. 30.
FIG. 36 is a top plan view of the tool bit of the bit assembly.
FIG. 37 is a right side elevational view of the tool bit of FIG. 36.
FIG. 38 is an inverted left side elevational view of the tool bit of FIG. 36.
FIG. 39 is a bottom plan view of the tool bit of FIG. 36.
FIG. 40 is a front end view of the tool bit as shown in FIG. 36.
FIG. 41 is a front end view of the tool bit as shown in FIG. 37.
FIG. 42 is a back end view of the tool bit of FIG. 38.
FIG. 43 is a back end view of the tool bit of FIG. 39.
Figures 44, 45, 46:
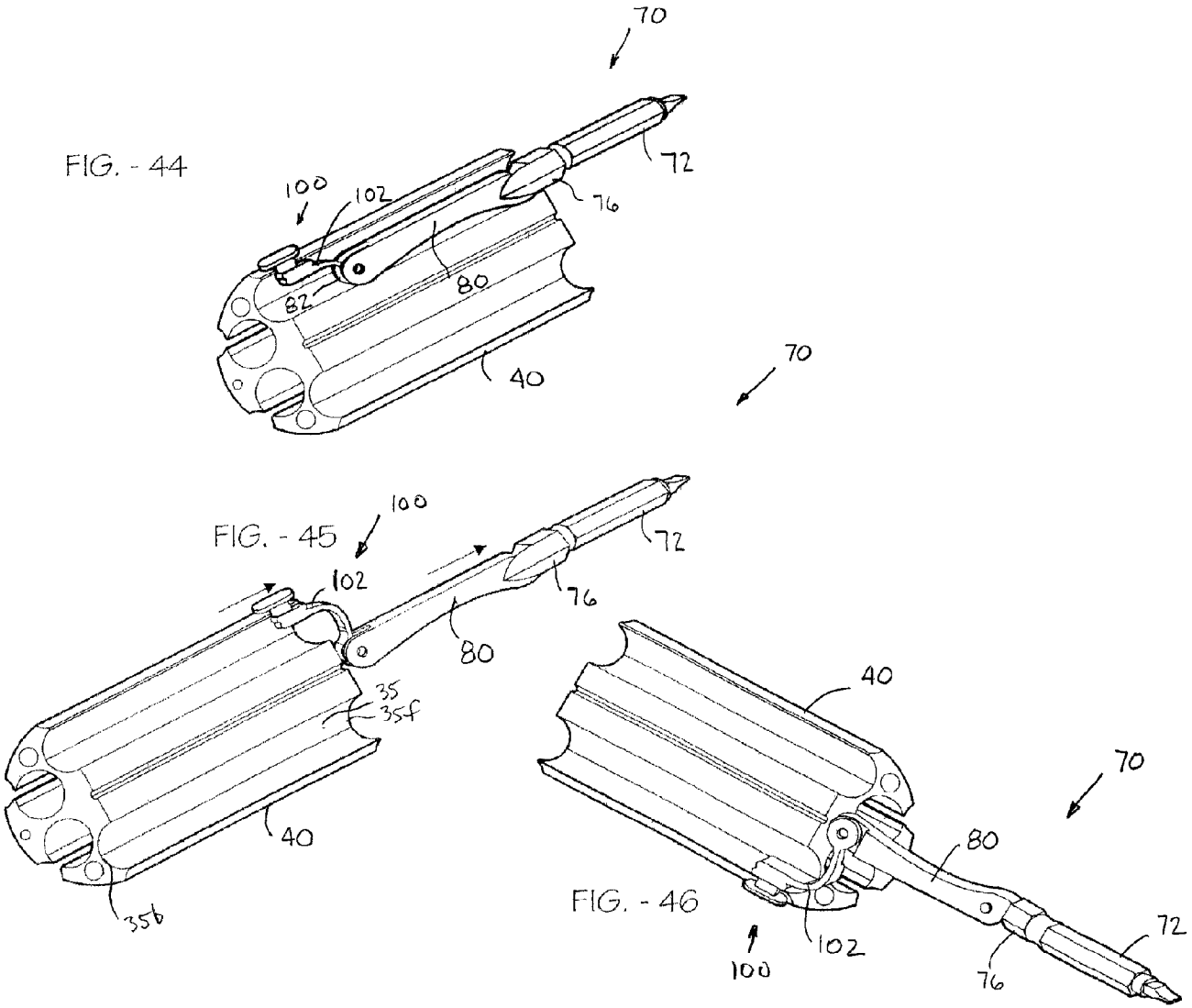
FIG. 44 is a perspective view from the back of the handle portion and a bit assembly mounted within the handle portion in the fully retracted position.
FIG. 45 is a perspective view similar to FIG. 44, but showing the movement of the actuator and the bit assembly to the fully extended position.
FIG. 46 is a perspective view from the front of the handle portion and a bit assembly in the fully extended position.
Figure 47:
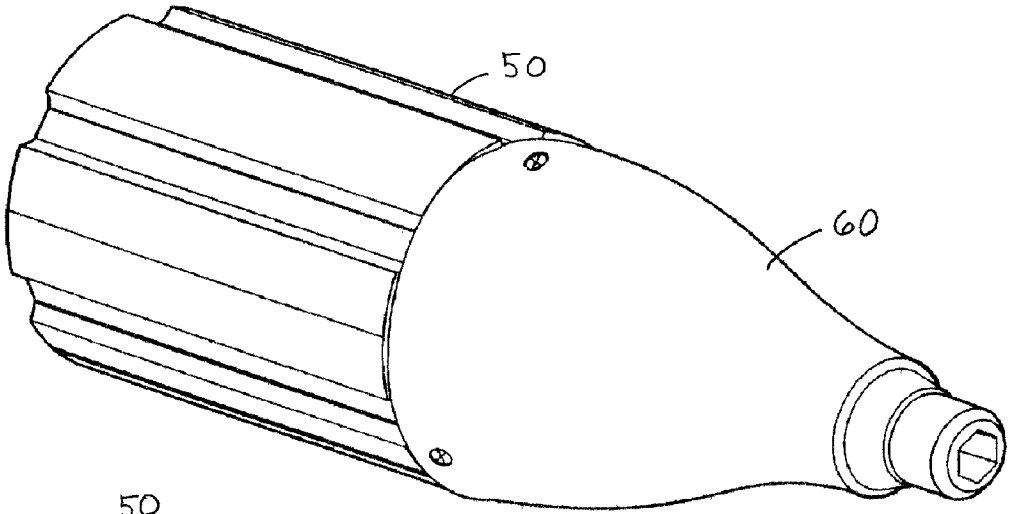
FIG. 47 is a front perspective view of the cone portion together with the central transition portion.
Figure 48:
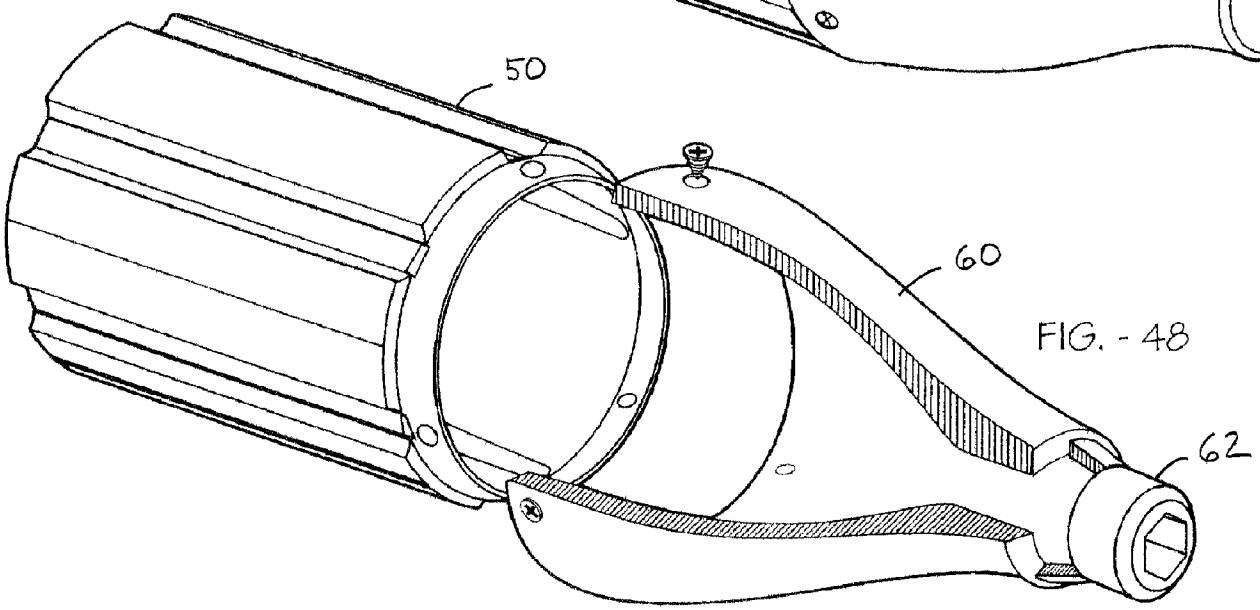
FIG. 48 is a partial cut away exploded perspective view of the cone portion together with the central transition portion.
Figures 49, 50:
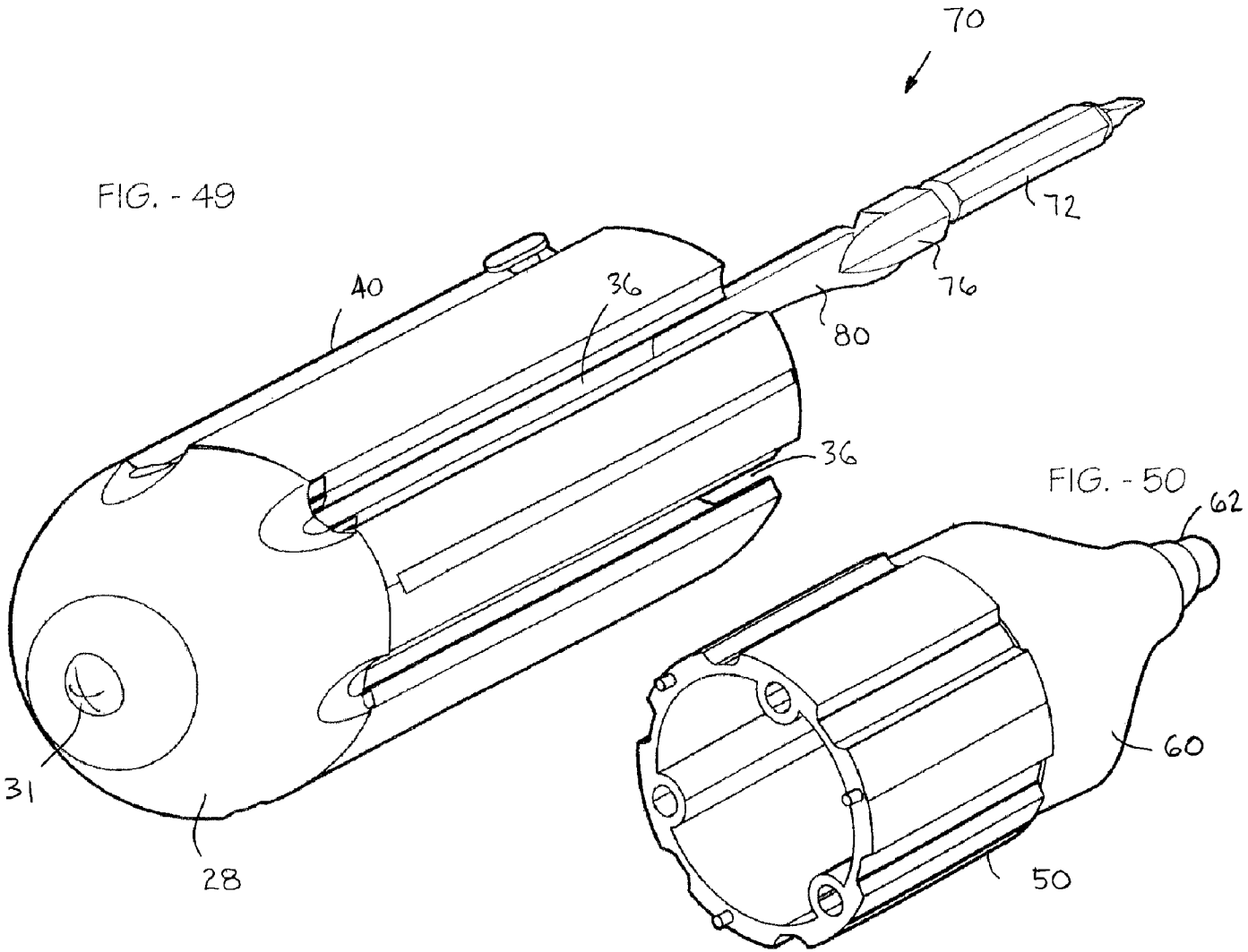
FIG. 49 is a rear perspective view of the handle portion together with the end cap and a single bit assembly.
FIG. 50 is a rear perspective view of the central transition section together with the cone section.
Figure 51:
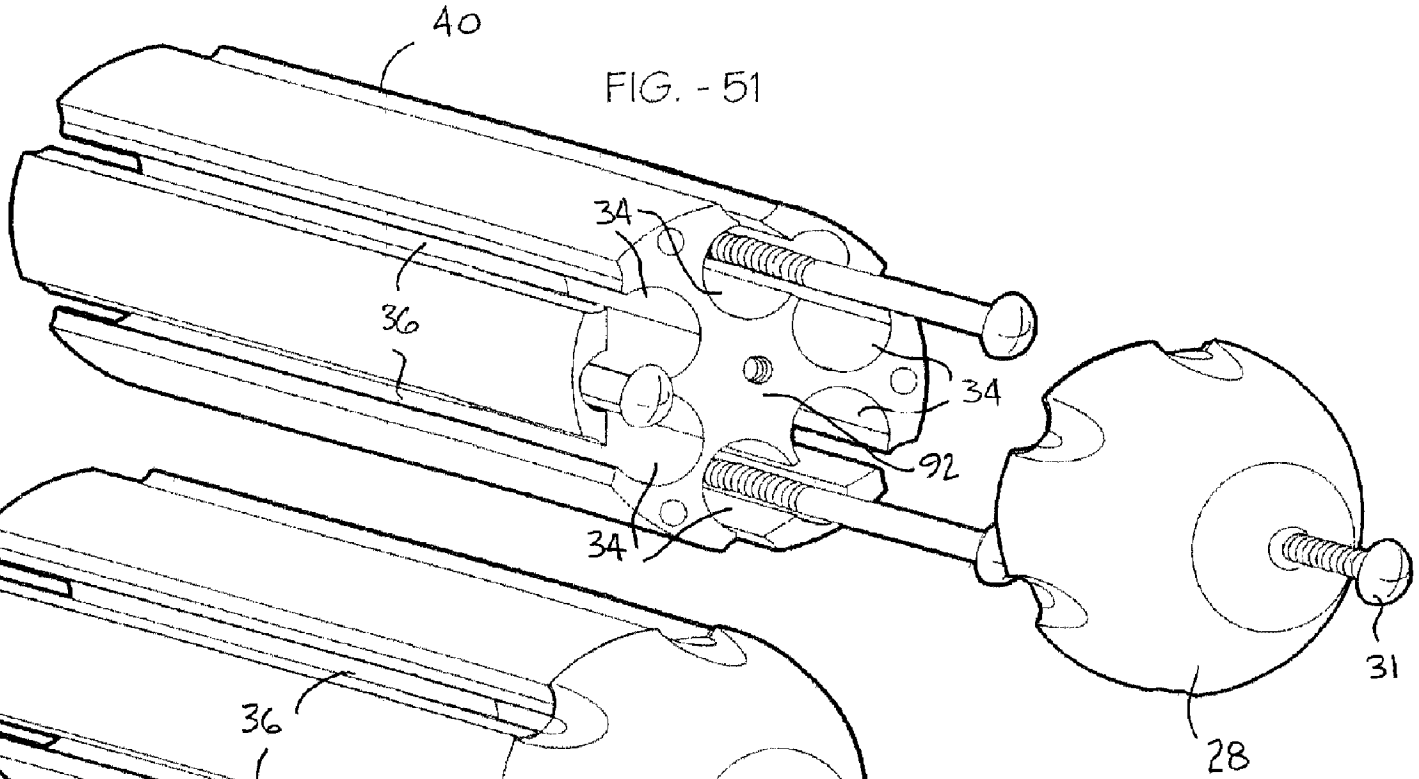
FIG. 51 is an exploded rear perspective view of the body portion and the end cap; and, FIG. 52 is an assembled rear perspective view of the body portion together with the end cap.

An actuator means, as indicated by the general reference numeral 100 extends from each bit assembly 70 exteriorly to the housing 30 for operative engagement by a user. In the preferred embodiment, as illustrated, each actuator means comprises a flexible actuator member 102. Each actuator member 102 comprises a unitary molded plastic piece and has an attachment portion 110 and a mounting portion 120 connected together by a flexible connector portion 130. The flexible connector portion 130 may be resiliently flexible so as to return to its original shape, as can be best seen in FIGS. 26 and 28. The flexible actuator member 102 does need to be sufficiently rigid to be able to push the attachment portion 110 laterally so as to move the back end 86 of the bit extension 80 in a lateral direction onto the forward facing abutment surface 92 on the central column 32.

Each actuator member 102 is operatively attached in hinged relation to a co-operating bit assembly 70 at the attachment portion 110. In the preferred embodiment, as illustrated, each actuator member 102 is operatively attached in pivoting relation to a co-operating bit assembly 70 by means of a pivot pin 122 projecting laterally outwardly from the attachment portion 110. The pivot pin 122 extends through a co-operating aperture 84 in the bit extension 80 adjacent the back end 86 thereof. Alternatively, a living hinge arrangement could be used to operatively attach the actuator member 102 in hinged relation to a co-operating bit assembly 70.

The mounting portion 120 comprises a stem portion 122 that extends through a slot 36 and terminates at a button portion 124 disposed exteriorly to the housing 30. In this manner, the actuator member 102 is mounted in slidable relation within a slot 36 that is oriented longitudinally along the housing 30.

The button portion 124 is preferably slightly concavely shaped and has formed therein a representation 106 of the shape of the attached tool bit 72, in order to make possible the identification of a desired tool bit 72 when it is in the housing 30.

Each actuator member 102 further comprises a flexible biasing arm 116 projecting outwardly from the mounting portion 120 for biased engagement with the central column 32. In this manner, the actuator member 102 is frictionally retained within the slot 36 for controlled sliding movement, in order to minimize looseness and play.

The actuator member 102 extends from a bit assembly 70 exteriorly to the housing 30, as aforesaid, for co-operative movement of the actuator member 102 and the bit assembly 70 between a retracted configuration, a forwardly extended intermediate configuration and a forwardly extended in-use configuration. In the retracted configuration, the bit assemblies 70 are retained within the housing 30, as can be best seen in FIG. 12. In the forwardly extended intermediate configuration, the tool bit 72 extends outwardly from the housing 30. Further, the bit assembly 70 contacts the rearward facing abutment surface 90, which contact limits the forward motion of the bit assembly 70. Further forward sliding movement of the actuator member 102, as accommodated by the flexible actuator member 102, causes the bit assembly 70 to move to its forwardly extended in-use configuration, as can be best seen in FIG. 14. More specifically, the forward movement of the user engageable button portion 124 on the mounting portion 120 of the flexible actuator member 102 causes flexible connector portion 130 to move the attachment portion 110 to the end of the channel 34. Accordingly, the contact surface 82 of the bit extension 80 is removed from the channel 34. At that point, the flexible connector portion 130 pushes the attachment portion 110 laterally so as to move the back end 86 of the bit extension 80 in a lateral direction onto the forward facing abutment surface 92 on the central column 32. The bit assembly 70 is then in its forwardly extended in-use configuration.

In the forwardly extended in-use configuration, the contact surface 82 of the bit assembly 70 is disposed in longitudinal force transmitting engagement against the forward facing abutment surface 92 to preclude rearward movement of the bit assembly 70 due to substantially longitudinally directed forces transmitted from the tool bit 72. Rearwardly directed longitudinal forces are transmitted from the tool bit 72, through the first stop surface 74 on the tool bit 72, to the second stop surface 82 on the bit extension 80, through the bit extension 80, and to the forward facing abutment surface 92.

In the forwardly extended in-use configuration, the contact surface 82 of the bit extension 80 disposed in longitudinal force transmitting engagement against the forward facing abutment surface 92, and the bit assembly 70 in contact with the rearward facing abutment surface 90. Accordingly, the overmolded plastic back end portion 76 is compressed slightly so as to ensure that the bit assembly 70 is retained snugly between the forward facing abutment surface 92 and the rearward facing abutment surface 90.

The actuator member 102 and the bit assembly 70 then move back to the retracted configuration in the following manner. The contact surface 82 of the bit assembly 70 is removed in a lateral direction from the longitudinal force transmitting engagement with the forward facing abutment surface 92 by means of rearward movement of the user engageable button portion 124 (mounting portion) of the flexible actuator member 102, which in turn causes the attachment portion 110 of the flexible actuator member 102 to move the back end 86 of the bit extension 80 in a lateral direction off the forward facing abutment surface 92 on the central column 32, without having to first perform a separate unlocking function.

There is also a longitudinal channel 34 for each bit assembly 70, and each longitudinal channel 34 has a longitudinal guide surface 35. The longitudinal channel 34 and longitudinal guide surface 35 each have a front end 34*f*, 35*f*, respectively, and a back end 34*b*, 35*b*, respectively. The forward facing abutment surface 92 on the central column 32 is disposed at the front end of each longitudinal channel 34 and each longitudinal guide surface 35, and is oriented substantially transversely to each longitudinal channel 34 and each longitudinal guide surface 35.

In use, each bit assembly 70 slides along its longitudinal channel 34 with at least part of the bit assembly 70 sliding along the longitudinal guide surface 35, between the retracted configuration and the forwardly extended in-use configuration, specifically before the forwardly extended intermediate configuration. When the back end 86 of the bit extension 80 reaches the front end 34*f* of the longitudinal channel 34 and the front end 35*f* of the longitudinal guide surface 35, the back end 86 of the bit extension 80 is moved in a lateral direction over the forward facing abutment surface 92 on the central column 32, to essentially "lock" the bit assembly 70 in place. This function happens automatically as the bit assembly 70 is moved forwardly into its forwardly extended in-use configuration. Accordingly, moving a bit assembly 70 from its retracted configuration to its forwardly extended in-use configuration is a one step process.

Figure 12:
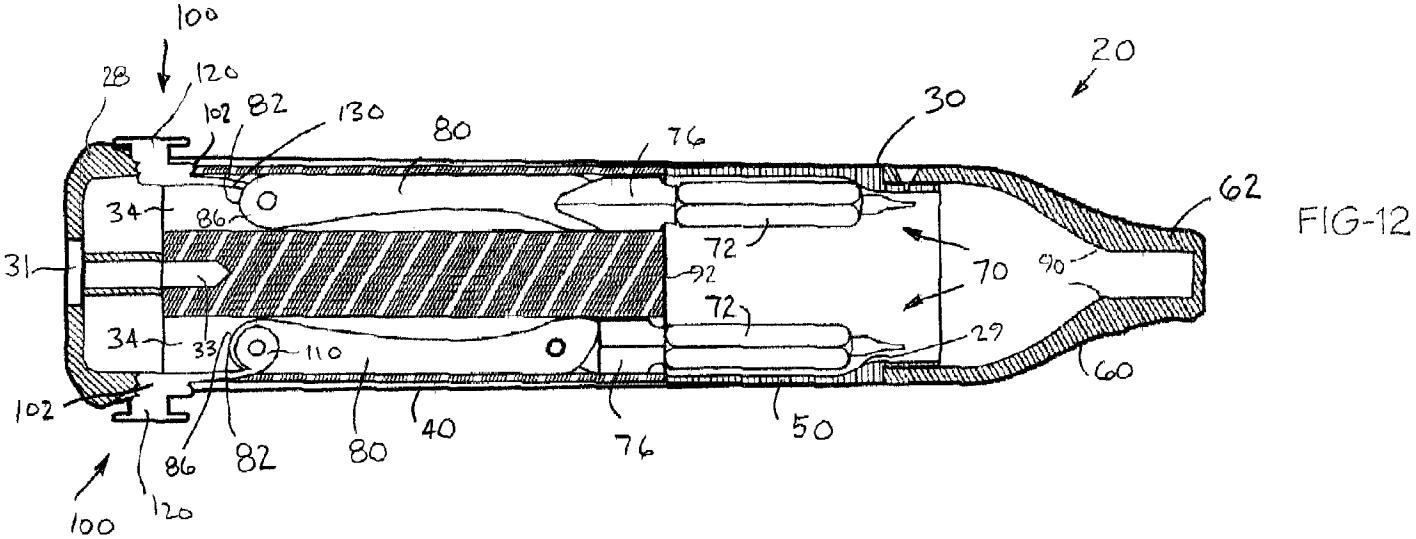
FIG. 12 is a cross-sectional side elevational view taken along section line A-A of FIG. 1, showing the bit assemblies in their retracted configuration.
Figure 13A:
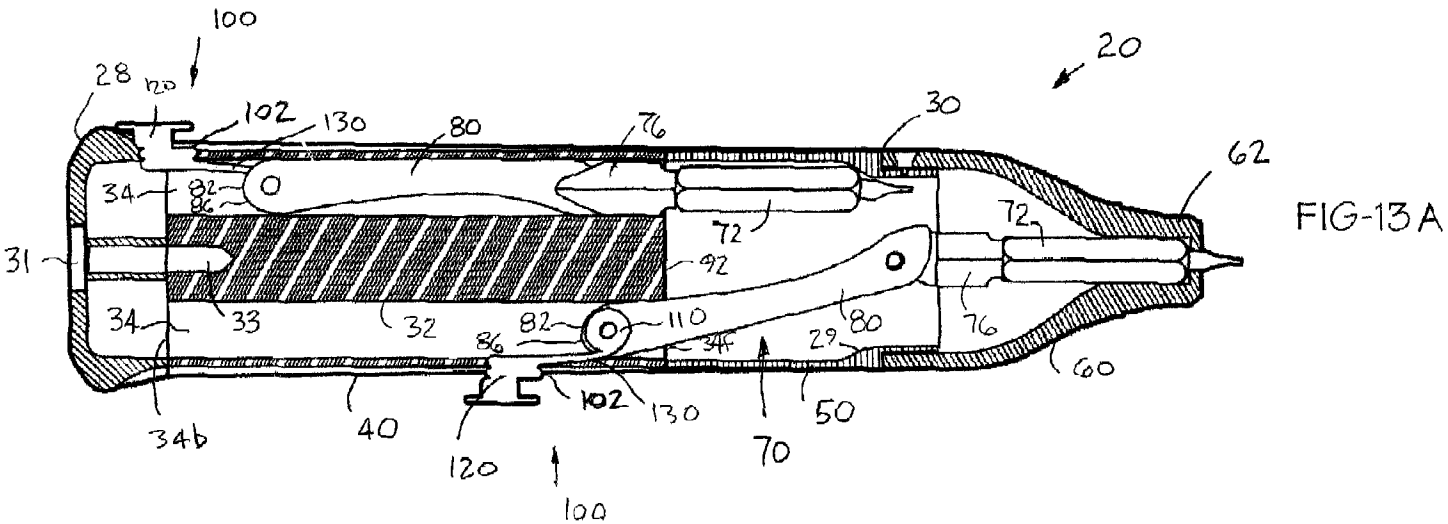
FIG. 13A is a cross-sectional side elevational view similar to FIG. 12, but showing one bit assembly in a partially extended configuration.
Figure 13B:
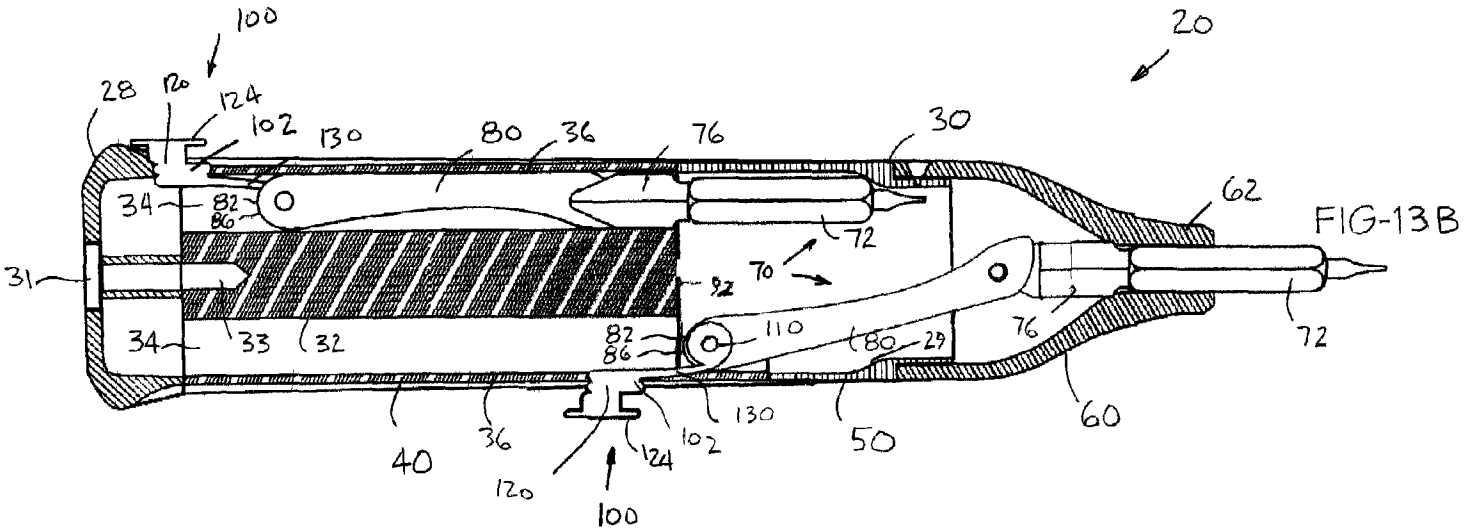
FIG. 13B is a cross-sectional side elevational view similar to FIG. 12, but showing one bit assembly in a partially extended configuration, but showing one bit assembly in a forwardly extended intermediate configuration.
Figure 14:
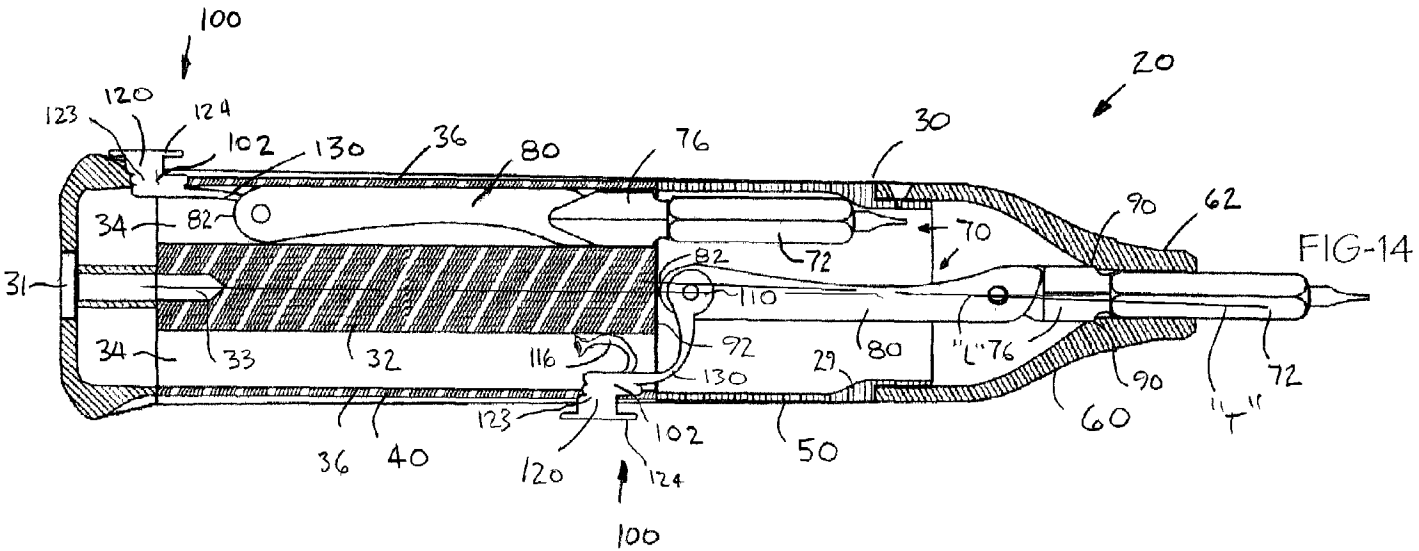
FIG. 14 is a cross-sectional side elevational view similar to FIG. 13, but showing one bit assembly in a forwardly extended in-use configuration.
Figures 15, 16:
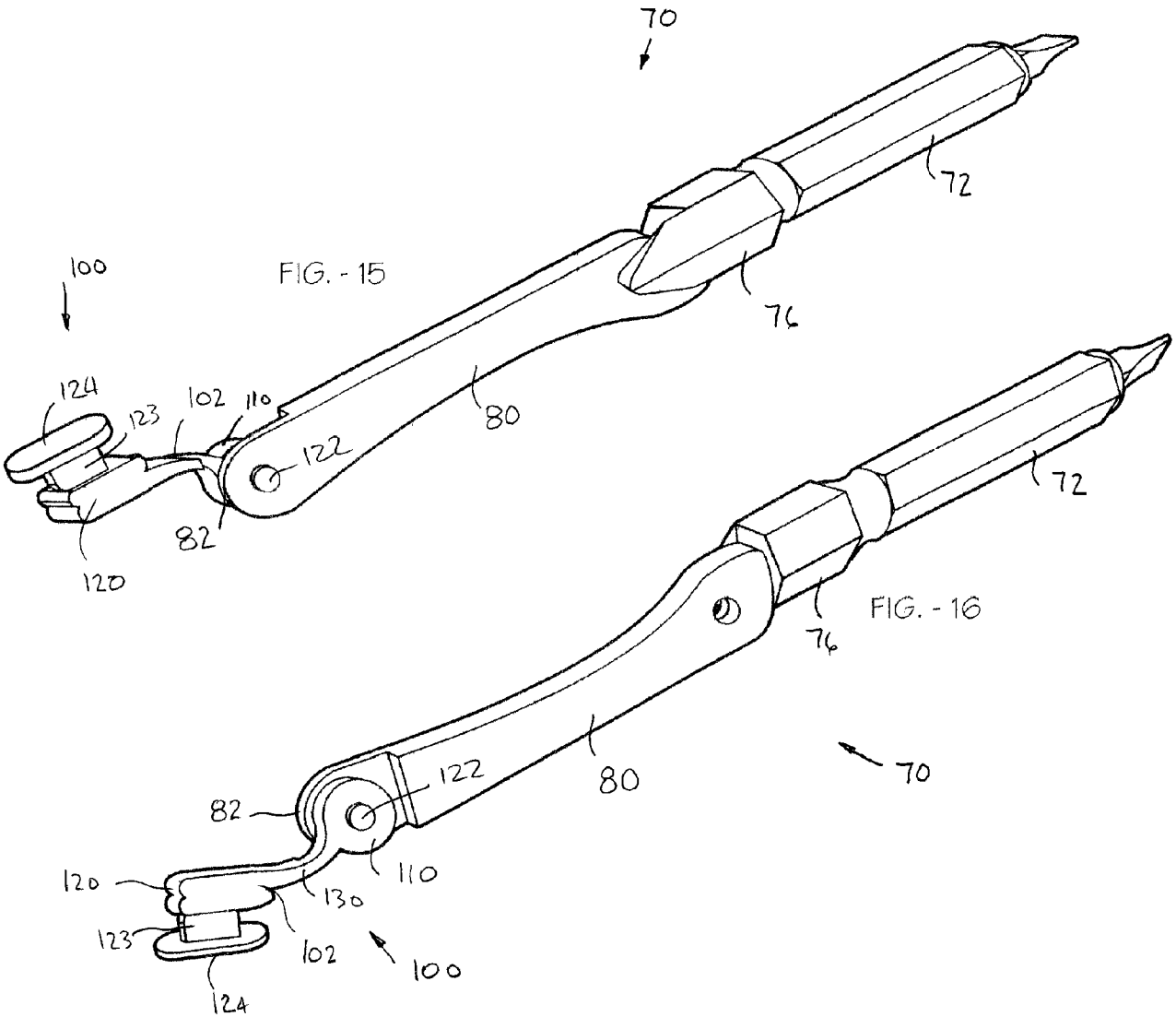
FIG. 15 is a right side perspective view of a complete bit assembly and attached actuator, as seen in FIGS. 12 through 14.
FIG. 16 is a left side inverted perspective view of the complete bit assembly and attached actuator of FIG. 15.
Figures 17, 18, 19, 20:
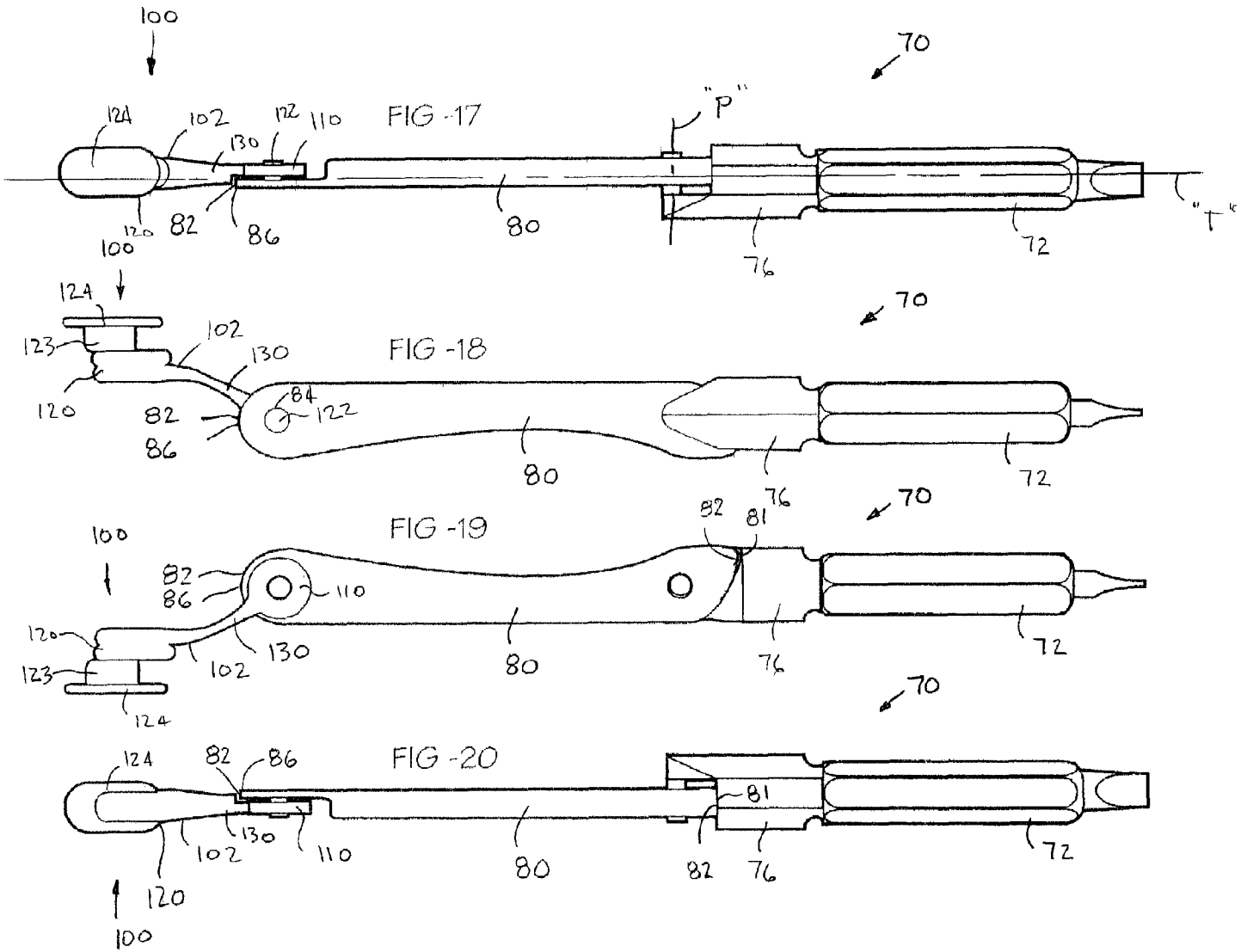
FIG. 17 is a top plan view of the complete bit assembly and attached actuator of FIG. 15.
FIG. 18 is a right side elevational view of the complete bit assembly and attached actuator of FIG. 15.
FIG. 19 is a left side elevational view of the complete bit assembly and attached actuator of FIG. 15.
FIG. 20 is a bottom plan view of the complete bit assembly and attached actuator of FIG. 15.
Figures 21, 22, 23:
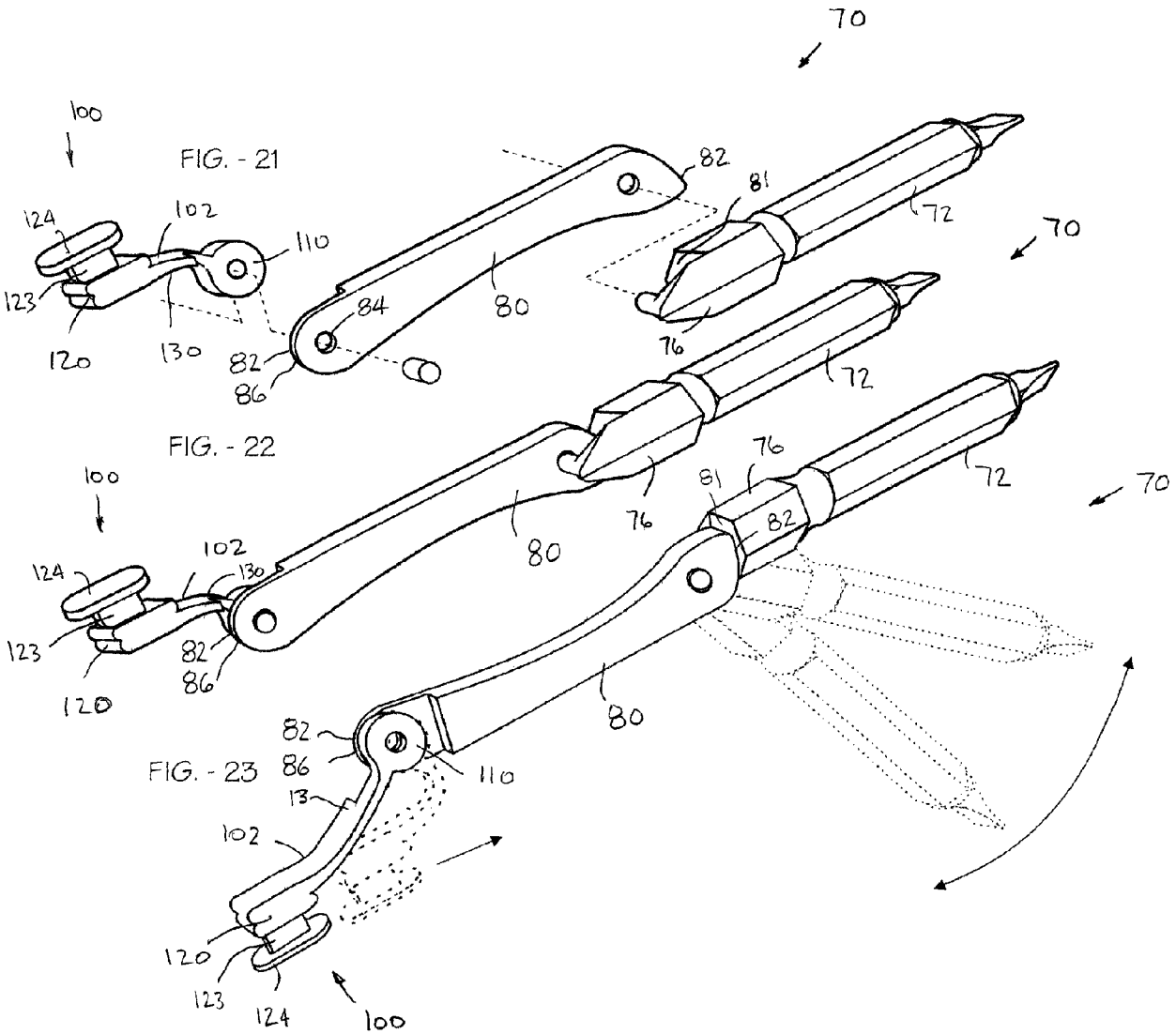
FIG. 21 is an exploded perspective view from the top right of the complete bit assembly and attached actuator of FIG. 15, showing the separate components.
FIG. 22 is a perspective view similar to FIG. 21, with the components having been assembled.
FIG. 23 is a perspective view from the bottom left (inverted) of the complete bit assembly and attached actuator of FIG. 15, and showing rotational movement of the tool bit and flexible movement of the actuator member in dashed lining.

The housing 30 further comprises a tool bit directing portion 29, as can be best seen in FIGS. 12 through 14. The tool bit directing portion 29 comprises a ramp disposed between the front end of the longitudinal channel 34 and the bit chuck 62. When a tool bit 72 slidingly contacts the ramp 29, as it moves from its retracted configuration towards its forwardly extended in-use configuration, the tool bit 72 is directed towards the bit-receiving opening 64 in the bit chuck 62, thus helping the tool bit 72 to subsequently enter the bit-receiving opening 64. The tool bit 72 also typically deflects off the cone portion 60 of the housing 30 adjacent the bit-receiving opening 64 in the bit chuck 62, in order to help guide the tool bit 72 into the bit-receiving opening 64.

As can be best seen in FIGS. 13 and 14, the bit chuck 62 aligns the tool bit 72 along the longitudinal axis "L". As can be best seen in FIG. 14, the contact surface 82 of the bit assembly 70 is disposed in longitudinal force transmitting engagement against the forward facing abutment surface 92, slightly past (or over) the longitudinal axis "L" with respect to the actuator means, as can be seen in FIG. 14. Accordingly, the tool bit axis "T" would be oriented at slight angle with respect to the longitudinal axis "L". This type of function is commonly referred to as over-the-centre, helps ensure that the rearwardly directed longitudinal forces do not push the back end 86 of the bit extension 80 off the forward facing abutment surface 92, thus providing proper operation of the multi-bit screwdriver against even strong rearwardly directed longitudinal forces from the tool bit 72.

As can be understood from the above description and from the accompanying drawings, the present invention provides a multi-bit screwdriver wherein the tool bits can be moved to their extended in-use configuration and then back to their retracted configuration using one hand only, which manipulation is easy to perform and which is a one step process, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the multi-bit screwdriver of the present invention without departing from the spirit and scope of the accompanying claims.

I claim:

1. In a multi-bit screwdriver having a plurality of bit assemblies operatively retained within a housing, said bit assemblies being selectively movable between a forwardly extended in-use configuration and a retracted configuration, the improvement comprising:

each said bit assembly having a tool bit at a front end and a contact surface at a back end;

a longitudinal channel for each bit assembly, having a front end and a back end, wherein each bit assembly slides along its longitudinal channel between said retracted configuration and said forwardly extended in-use configuration;

an abutment surface disposed at the front end of each said longitudinal channel and oriented substantially transversely to each said longitudinal channel, for receiving said contact surface of said bit assembly longitudinal force transmitting engagement when said bit assembly is in said forwardly extended in-use configuration.

2. In a multi-bit screwdriver having a plurality of bit assemblies operatively retained within a housing, said bit assemblies being selectively movable between a forwardly extended in-use configuration and a retracted configuration, the improvement comprising:

each said bit assembly having a tool bit at a front end and a contact surface at a back end;

a longitudinal guide surface for each bit assembly, having a front end and a back end, wherein each bit assembly slides along its longitudinal guide surface between said retracted configuration and said forwardly extended in-use configuration;

an abutment surface disposed at the front end of each said longitudinal guide surface and oriented substantially transversely to each said longitudinal guide surface, for receiving said contact surface of said bit assembly longitudinal force transmitting engagement when said bit assembly is in said forwardly extended in-use configuration.

3. In a multi-bit screwdriver having a plurality of bit assemblies operatively retained within a housing, said bit assemblies being selectively movable between a forwardly extended in-use configuration and a retracted configuration, the improvement comprising:

each said bit assembly having a tool bit with a first stop surface and a bit extension with a second stop surface, said tool bit defining a longitudinal axis, wherein said tool bit is pivotally attached to said bit extension for pivotal movement about a pivot axis oriented substantially transversely to said longitudinal axis, between an oblique angular position and a forward-oriented angular position whereat said first and second stop surfaces abut against each other.

4. A bit assembly for use in multi-bit driver, said bit assembly comprising:

a tool bit having a first stop surface; and, a bit extension having a second stop surface and defining a longitudinal tool bit axis; and, wherein said tool bit is pivotally attached to said bit extension for pivotal movement about a pivot axis oriented substantially transversely to said longitudinal tool bit axis, between an oblique angular position and a forward-oriented angular position whereat said first and second stop surfaces abut against each other in force transmitting relation.

5. The bit assembly of claim 4, wherein said tool bit comprises an overmolded back end portion, and said tool bit is pivotally attached at said overmolded back end portion to said bit extension.

* * * * *